US009863380B2

(12) United States Patent
Sakata et al.

(10) Patent No.: US 9,863,380 B2
(45) Date of Patent: Jan. 9, 2018

(54) FUEL INJECTION VALVE

(75) Inventors: Yukitaka Sakata, Chiyoda-ku (JP); Tsuyoshi Munezane, Chiyoda-ku (JP); Naoya Hashii, Chiyoda-ku (JP); Keisuke Ito, Chiyoda-ku (JP); Kyosuke Watanabe, Chiyoda-ku (JP); Shota Kawasaki, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/395,854

(22) PCT Filed: Aug. 9, 2012

(86) PCT No.: PCT/JP2012/070359
§ 371 (c)(1),
(2), (4) Date: Oct. 21, 2014

(87) PCT Pub. No.: WO2014/024292
PCT Pub. Date: Feb. 13, 2014

(65) Prior Publication Data

US 2015/0136877 A1 May 21, 2015

(51) Int. Cl.
*F02M 51/06* (2006.01)
*F02M 61/18* (2006.01)

(52) U.S. Cl.
CPC ..... *F02M 51/0632* (2013.01); *F02M 61/184* (2013.01); *F02M 61/1806* (2013.01);
(Continued)

(58) Field of Classification Search
CPC ..... F02M 51/0632; F02M 61/1806; F02M 61/1833; F02M 61/184; F02M 61/1853; F02M 61/188
(Continued)

(56) References Cited

U.S. PATENT DOCUMENTS 6,089,476 A * 7/2000 Sugimoto ..... F02M 61/1806 239/533.12
6,161,780 A * 12/2000 Sugimoto ..... F02M 61/1806 239/533.12
(Continued)

FOREIGN PATENT DOCUMENTS

JP 2001-046919 A 2/2001
JP 2002-004983 A 1/2002
(Continued)

OTHER PUBLICATIONS

International Search Report of PCT/JP2012/070359 dated Sep. 4, 2012 [PCT/ISA/210].

*Primary Examiner* — Arthur O Hall
*Assistant Examiner* — Joseph A Greenlund
(74) *Attorney, Agent, or Firm* — Sughrue Mion, PLLC; Richard C. Turner

(57) ABSTRACT

When injection-hole inlets and injection-hole outlets are projected vertically onto an X-Y plane (N) perpendicular to a valve-seat axial center, an injection-hole arrangement angle (θ), which is formed by a straight line (a) passing through a center of the injection-hole inlet of a reference injection hole and the valve-seat axial center and a straight line (b) passing through a center of the injection-hole inlet of the injection hole neighboring the reference injection hole and the valve-seat axial center on the plane (N), is set so as to become smaller as being closer to a Y-axis. A fuel turn angle (α) on a wide-angle side, which is formed by the straight line (a) and a straight line (c) passing through a center of the injection-hole inlet and a center of the injection-hole outlet on the plane (N), has a relationship: $90° < \alpha < 180°$.

9 Claims, 10 Drawing Sheets

(52) U.S. Cl.
CPC ..... *F02M 61/188* (2013.01); *F02M 61/1833* (2013.01); *F02M 61/1853* (2013.01)

(58) Field of Classification Search
USPC ..... 239/533.12, 596, 552, 556–558
See application file for complete search history.

(56) References Cited

U.S. PATENT DOCUMENTS 6,170,763 B1 * 1/2001 Fuchs ..... F02M 61/162 239/533.11
6,405,946 B1 6/2002 Harata et al.
6,742,727 B1 * 6/2004 Peterson, Jr. ..... F02M 61/1853 239/533.11
6,758,420 B2 * 7/2004 Arioka ..... F02M 51/0682 239/533.12
6,783,085 B2 * 8/2004 Xu ..... F02M 61/162 239/463
6,817,545 B2 * 11/2004 Xu ..... F02M 61/1806 239/533.12
6,848,635 B2 * 2/2005 Xu ..... F02M 61/162 239/502
7,124,963 B2 * 10/2006 Goenka ..... B05B 1/14 239/504
8,002,207 B2 * 8/2011 Hashii ..... F02M 51/0682 239/533.12
8,191,800 B2 * 6/2012 Kitagawa ..... F02M 51/061 239/533.12
8,231,069 B2 * 7/2012 Matsumura ..... F02M 61/1853 239/518
8,302,886 B2 * 11/2012 Hashii ..... F02M 51/0667 239/533.12
8,360,338 B2 * 1/2013 Gunji ..... F02M 61/168 239/5
8,657,213 B2 * 2/2014 Sakata ..... F02M 61/1853 239/533.12
8,794,550 B2 * 8/2014 Kaneko ..... F02M 61/1853 239/552
8,919,674 B2 * 12/2014 Watanabe ..... F02M 61/1806 239/533.11
8,919,675 B2 * 12/2014 Sakata ..... F02M 61/1806 239/5
2003/0234006 A1 12/2003 Saito et al.
2004/0074996 A1 4/2004 Munezane et al.
2011/0253812 A1 10/2011 Sakata et al.
2013/0099015 A1 * 4/2013 Sumida ..... F02M 61/184 239/1
2014/0151468 A1 * 6/2014 Yasukawa ..... F02M 61/1813 239/562
2015/0129687 A1 * 5/2015 Kaneta ..... F02M 61/1833 239/585.5

FOREIGN PATENT DOCUMENTS

JP 2004-076723 A 3/2004
JP 2004-137931 A 5/2004
JP 2006-002620 A 1/2006
JP 2010-077865 A 4/2010
JP 2011-226334 A 11/2011
JP 2012-122441 A 6/2012

* cited by examiner

CROSS SECTION ALONG C-C

ENLARGED PORTION D

FUEL INJECTION VALVE

CROSS REFERENCE TO RELATED APPLICATIONS

This application is a National Stage of International Application No. PCT/JP2012/070359, filed Aug. 9, 2012, the contents of which are incorporated herein by reference in its entirety.

TECHNICAL FIELD

The present invention relates to an electromagnetic fuel injection valve to be used for a fuel supply system for an internal combustion engine, and more particularly, to a fuel injection valve that realizes both spray directivity and atomization as spray characteristics of the fuel injection valve.

BACKGROUND ART

In recent years, along with a trend toward stricter regulations on exhaust-gas emissions from automobiles or the like, combustion efficiency of an internal combustion engine has been required to be improved.

In general, in any of injection holes of a fuel injection valve, as a fuel liquid film spreads thinly in the injection hole, particle diameter of a droplet formed by breakup of the liquid film after the injection becomes smaller. However, an angle of the liquid film injected from a single injection hole (hereinafter referred to as "single spray angle") becomes larger. At this time, the spray particle diameter and the single spray angle have a tradeoff relationship as indicated on the vertical axis and the horizontal axis of FIG. 13.

Hitherto, in an internal combustion engine, which injects the fuel toward an intake valve provided to a distal end of an intake port, the fuel is caused to adhere to the intake valve and the vaporized fuel is supplied to a combustion chamber.

However, when a spray angle of a spray aggregate obtained by aggregating a plurality of the single sprays is set too large after the single spray angle is increased with insufficient atomization, the amount of spray, which is located on the outer side with respect to a central axis of the spray, adhering to an inner wall of the intake port increases at the time of injection. Therefore, there is a problem in that engine controllability is lowered.

Moreover, when the spray adhering to the intake port becomes the liquid film, which then flows along the inner wall of the intake port into the combustion chamber, there is a problem in that the degradation of the exhaust-gas emission performance and lowered combustion efficiency are caused.

As solutions to the above-mentioned problems, a variety of technologies to realize both the atomization and the aggregation of the sprays have been proposed (see, for example, Patent Literatures 1 and 2).

In Patent Literature 1, a plurality of injection holes formed through an injection-hole plate are formed on a radially outer side of a valve-seat opening inner wall that is a portion having a minimum inner diameter of the valve seat with a diameter reduced toward a downstream side. A cavity that brings the valve-seat opening inner wall and the injection holes into communication with each other is formed in a downstream-side end surface of the valve seat.

Moreover, when a plurality of injection-hole inlets are projected onto a plane that is perpendicular to a valve-seat axial center, a distance between an outermost diameter of the plurality of injection holes and an outer circumferential wall of the cavity is set equal to or larger than the diameter of the injection hole.

In this manner, when the valve is opened, a fuel flow from a valve-seat axial center toward the center of the injection hole and a fuel flow corresponding to a part of the flow along an outer circumferential surface of the cavity through portions between the injection holes into the injection holes are caused to collide against each other to cause a turbulence in the fuel flow, thereby breaking up the liquid film so as to realize promotion of the atomization.

In Patent Literature 2, a long axis and a short axis that is shorter than the long axis and is perpendicular to the long axis are defined at an end portion of the valve-seat opening. A fuel chamber having a long axis longer than the inner diameter of the valve-seat opening and a short axis shorter than the inner diameter of the valve-seat opening is provided. Inside the fuel chamber, the injection holes are formed.

As a result, the fuel flows to the radially outer side with respect to the valve-seat axial center to form a swirl flow in the combustion chamber and form the injected fuel into the thinner film. In this manner, the promotion of the atomization is realized.

By the way, in order to clarify a mechanism of the atomization of the fuel spray, the fuel injected from the injection holes is first photographed in an enlarged manner. As a result, it is proven that the fuel breakup process proceeds from "liquid film" through "liquid thread" to "droplet" by a force for diffusing the fuel that overcomes a surface tension.

Moreover, it is also proven that the effects of the surface tension become greater after the fuel once becomes the liquid droplets and therefore the breakup less liable to occur from then on.

Thus, it is proven that a higher degree of atomization can be achieved when the "thin liquid film" with smaller fuel turbulence is injected from the injection holes and the liquid film is further spread thinly to be then broken up. On the contrary, when the turbulence occurs in the fuel flow, the breakup occurs in a state of a "thick liquid film" before the fuel liquid film is spread thinly. Therefore, the droplets after the breakup also become larger.

Moreover, in the fuel injection valve including the plurality of injection holes formed through the injection-hole plate, which are arranged on the radially outer side of the valve-seat opening inner wall, and the cavity that brings the valve-seat opening inner wall and the injection holes into communication with each other, when the valve is opened, the fuel spreads radially from the valve-seat axial center inside the cavity to flow toward the center of the injection hole.

Therefore, when the spray aggregate is sprayed from the fuel injection valve in a plurality of directions, an orientation of the flow of the fuel flowing into the injection hole suddenly changes in the injection hole toward a desired injection direction. Therefore, the swirl flow is formed in each of the injection holes. At this time, the swirl flow generated in the injection holes is to spread the fuel into the thin liquid film without causing the turbulence in the fuel flow. Therefore, it is proven that the injected particle diameter can be reduced.

In neither Patent Literature 1 nor Patent Literature 2, however, the clarified atomization mechanism described above is appropriately used.

CITATION LIST

Patent Literature

[PTL 1] JP 2001-46919 A
[PTL 2] JP 2006-2620 A

SUMMARY OF INVENTION

Technical Problem

In the case of Patent Literature 1, the related-art fuel injection valve promotes, when the valve is opened, the collision between the fuel flow from the valve-seat axial center toward the center of the injection hole and the fuel flow corresponding to the part of the flow passing along the outer circumferential surface of the cavity through portions between the injection holes into the injection holes to cause the turbulence in the fuel flow. Therefore, there is a problem in that the particle diameter degrades.

Moreover, there is another problem in that the arrangement of the injection holes for forming the swirl flow in each of the injection holes is not defined.

On the other hand, in the case of Patent Literature 2, the swirl flow formed in the fuel chamber flows into the injection holes. As a result, a swirl spray can be injected. However, the swirl flow is required to be reinforced to such a degree that the atomization is promoted. Therefore, there is a problem in that the spray angle of the spray aggregate becomes too large to cause difficulty in realizing both the atomization and the aggregation of the sprays.

Moreover, in the case of Patent Literature 2, the injection hole diameter is reduced to increase the number of injection holes so as to reduce a flow rate injected from each of the injection holes. In this manner, the formation of the fuel into the thinner film inside the injection holes is facilitated to enable the promotion of the atomization. However, the injection holes can be provided only in four corners of the fuel chamber. Therefore, the number of injection holes cannot be increased to be equal to or larger than four. Thus, there is a problem in that the above-mentioned configuration is not adaptable to the promotion of the atomization becomes difficult.

Further, the injection hole diameter and the number of injection holes are limited for the atomization. Therefore, there is a problem in that the fuel injection valves having various flow rates.

The present invention has been made to solve the problems described above, and has an object to provide a fuel injection valve configured to generate an excellent swirl flow while holding down costs with a simple shape, to thereby realize promotion of both atomization and aggregation of sprays.

Solution to Problem

According to one embodiment of the present invention, there is provided a fuel injection valve, including: a valve seat having a valve-seat seating surface provided on an open end of the fuel injection valve; a valve element provided so as to be opposed to the valve seat, for opening and closing the valve seat; and an injection-hole plate mounted on a downstream side of the valve seat, having a plurality of injection holes. The fuel injection valve is configured to operate the valve element in a valve-opening direction in response to an operation signal from an engine control unit so as to allow a fuel to pass between the valve element and the valve-seat seating surface, to thereby inject a spray aggregate from the plurality of injection holes toward an intake valve. The plurality of injection holes are formed on a radially outer side of a valve-seat opening inner wall that is a portion having a minimum inner diameter of the valve seat with a diameter reduced toward the downstream side. The valve seat has a cavity formed in a downstream-side end surface of the valve seat, for bringing the valve-seat opening inner wall and each of the plurality of injection holes into communication with each other. When a straight line obtained by projecting a cylinder central axis O of an engine onto a plane N that is perpendicular to a valve-seat axial center of the valve seat is a P-axis, a straight line passing through the valve-seat axial center and being perpendicular to the P-axis on the plane N is an X-axis, a straight line parallel to the P-axis on the plane N is a Y-axis, and when one of the plurality of injection holes in a case where injection-hole inlets and injection-hole outlets of the plurality of injection holes are projected vertically onto the plane N is set as a reference injection hole, an inter-injection hole angle $\theta$, which is formed by a straight line a passing through a center of the injection-hole inlet of the reference injection hole and the valve-seat axial center and a straight line b passing through a center of the injection-hole inlet of the injection hole neighboring the reference injection hole and the valve-seat axial center on the plane N, is set so as to become smaller as being closer to the Y-axis, and a fuel turn angle $\alpha$ on a wide-angle side in an angle formed by the straight line a and a straight line c passing through the center of the injection-hole inlet and a center of the injection-hole outlet on the plane N satisfies a relationship: $90° < \alpha < 180°$. The injection-hole plate includes concave portions formed on a downstream-side end surface of the injection-hole plate on a one-to-one basis with respect to the plurality of injection holes, each having a larger opening area than an opening area of the each of the plurality of injection holes. The concave portions are arranged so that a region where an injection-hole length is short becomes larger on a side of a desired injection direction than on an opposite side with respect to the straight line c.

Advantageous Effects of Invention

According to one embodiment of the present invention, a swirl flow is formed in each of the injection holes by a fuel main flow toward the center of the injection-hole inlet and a fuel flow flowing into the edge of the injection hole along the inner wall surface of the injection hole, and the swirl flow is pressed against the inner wall surface of the injection hole on the radially outer side of the valve-seat axial center by a fuel flow that is to flow into the injection hole in a direction that is substantially perpendicular. In this manner, the fuel can be formed into a thinner film.

DESCRIPTION OF EMBODIMENTS

First Embodiment

Figure 1:
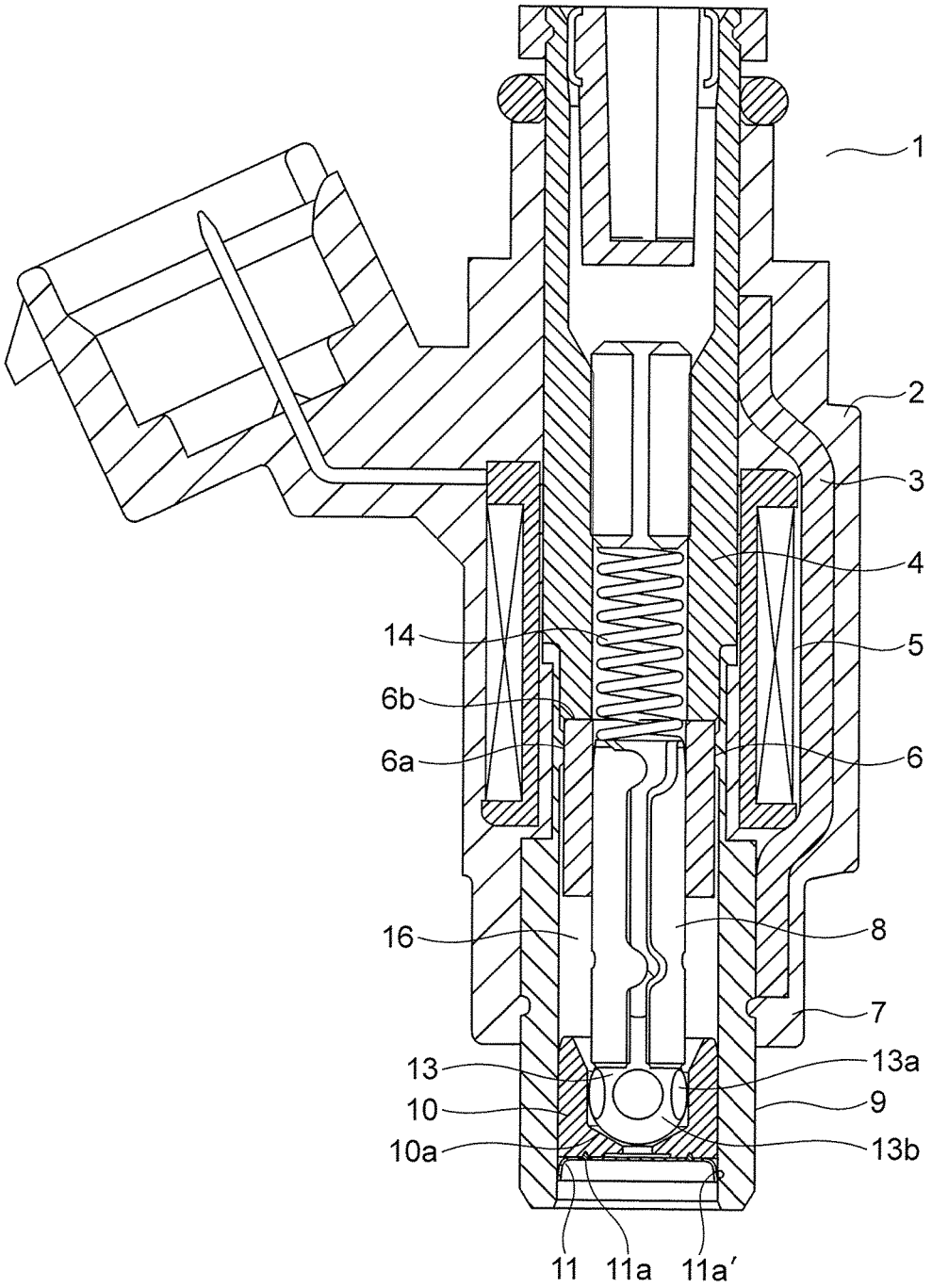
FIG. 1 is a sectional view illustrating a fuel injection valve according to a first embodiment of the present invention.

FIG. 1 is a sectional view illustrating a fuel injection valve according to a first embodiment of the present invention.

In FIG. 1, a fuel injection valve 1 includes a solenoid device 2, a housing 3, which is a yoke portion of a magnetic circuit, a core 4, which is a fixed core portion of the magnetic circuit, a coil 5, an armature 6, which is a movable core portion of the magnetic circuit, and a valve device 7.

The valve device 7 includes a valve element 8 having a cylindrical shape, a valve main body 9, and a valve seat 10. The valve element 8 includes a valve-element distal end portion 13 having a ball-like shape at its distal end.

The valve main body 9 is welded after being press-fitted over an outer diameter portion of the core 4. Moreover, the armature 6 is welded after being press-fitted over the valve element 8.

After an injection-hole plate 11 is inserted into the valve main body 9 under a state in which a welded portion 11*a* thereof is connected to a downstream side of the valve seat 10, the valve seat 10 is connected at a welded portion 11*a*'.

A plurality of injection holes 12 (see FIGS. 2 to 4) passing in a plate thickness direction are formed through the injection-hole plate 11.

Moreover, a compression spring 14 that presses the valve element 8 in a valve-closing direction is inserted into the core 4.

Further, a drive circuit (not shown) for driving the fuel injection valve 1 in response to an operation signal from an engine control unit (not shown) is provided to the fuel injection valve 1.

Next, an operation of the fuel injection valve 1 according to the first embodiment of the present invention, which is illustrated in FIG. 1, is described.

When the operation signal is transmitted from the engine control unit to the drive circuit for the fuel injection valve 1, a current starts flowing through the coil 5 of the fuel injection valve 1 to generate magnetic fluxes in the magnetic circuit including the armature 6, the core 4, the housing 3, and the valve main body 9. The armature 6 performs an attracting operation toward the core 4.

As a result, the valve element 8 having a structure integral with the armature 6 is separated away from a valve-seat seating surface 10*a* to form a gap. Then, a fuel 16 that is pressurized and received inside the fuel injection hole 1 passes through a plurality of grooves 13*a* formed at the valve-element distal end portion 13 and through the gap between the valve-seat seating surface 10*a* and the valve element 8 to be injected toward an intake valve 21 inside an engine intake pipe 20 (see FIG. 5).

Next, an operation stop signal is transmitted from the engine control unit to the drive circuit for the fuel injection valve 1, the flow of the current through the coil 5 is stopped to reduce the magnetic fluxes in the magnetic circuit. Therefore, the gap between the valve element 8 and the valve-seat seating surface 10*a* is brought into a closed state by the compression spring 14 that presses the valve element 8 in a valve-closing direction, thereby terminating the fuel injection.

The valve element 8 slides on a guide portion between the valve element 8 and the valve main body 9 on an armature outer side surface 6*a* and a sliding surface 13*b* of the valve-element distal end portion 13. In the valve-open state, an upper surface 6*b* comes into contact with a lower surface of the core 4.

Figure 2:
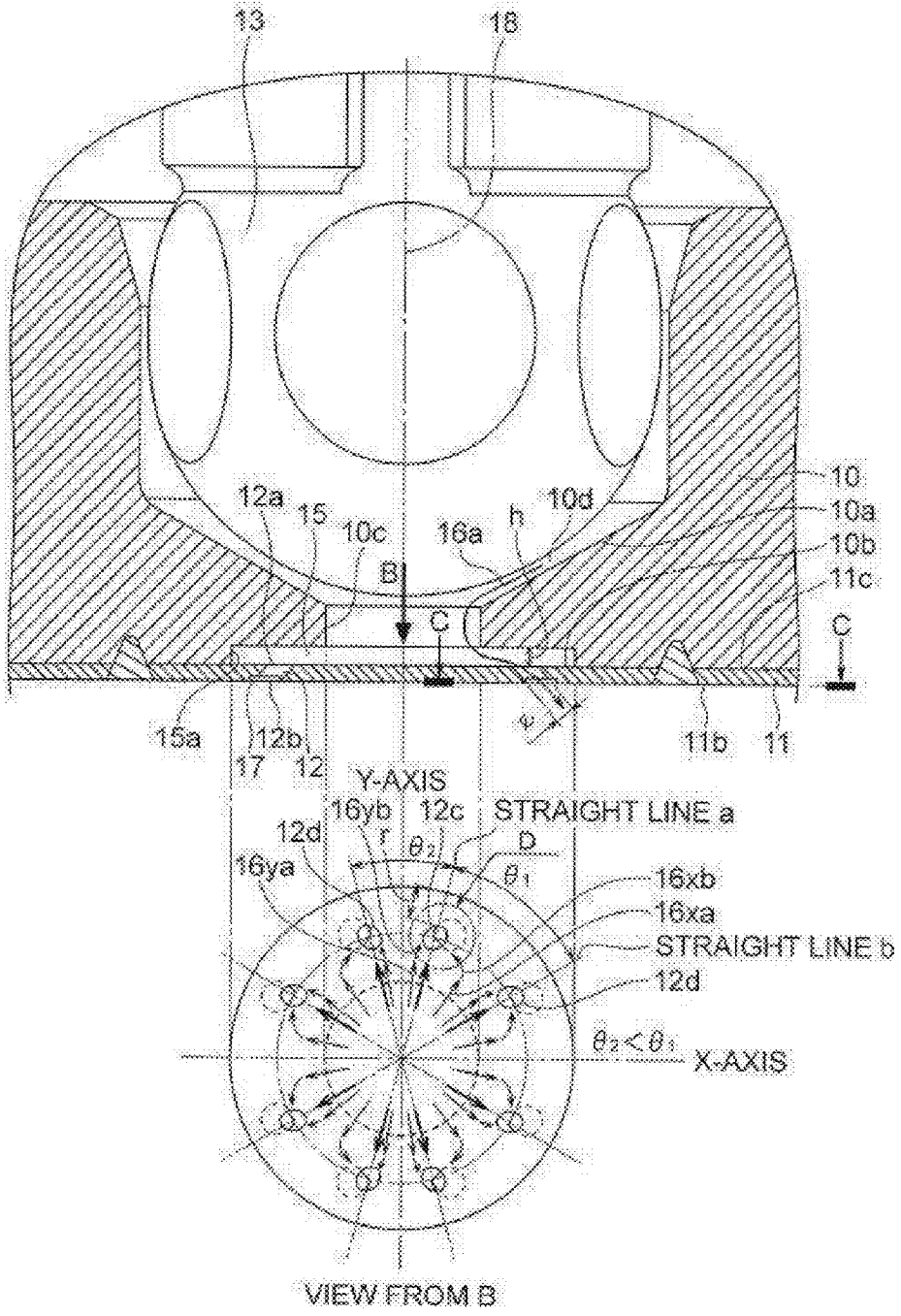
FIG. 2 is a sectional view and a plan view illustrating a distal end portion of the fuel injection valve according to the first embodiment of the present invention in an enlarged manner.

FIG. 2 illustrates a sectional view and a plan view of a distal end portion of the fuel injection valve 1 in an enlarged manner. The plan view of FIG. 2 illustrates a state as viewed from the arrow B on the sectional view of FIG. 2

Figure 3:
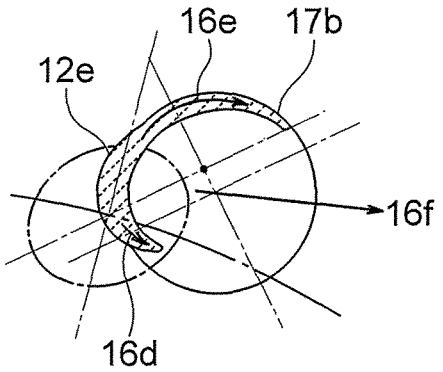
FIG. 3 is a sectional view taken along the line C-C in FIG. 2.
Figure 4:
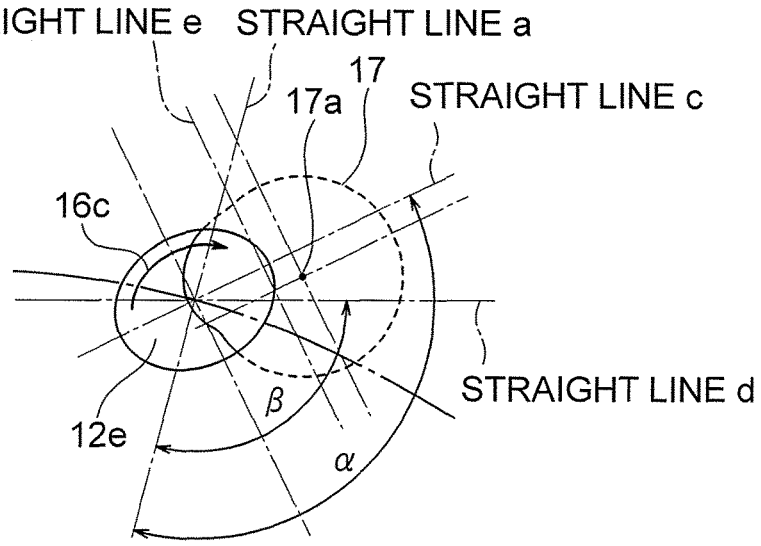
FIG. 4 is a plan view illustrating the portion D illustrated in FIG. 2 in an enlarger manner.

Moreover, FIG. 3 is a sectional view taken along the line C-C in FIG. 2, and FIG. 4 is a plan view illustrating a portion D illustrated in FIG. 2.

Figure 5:
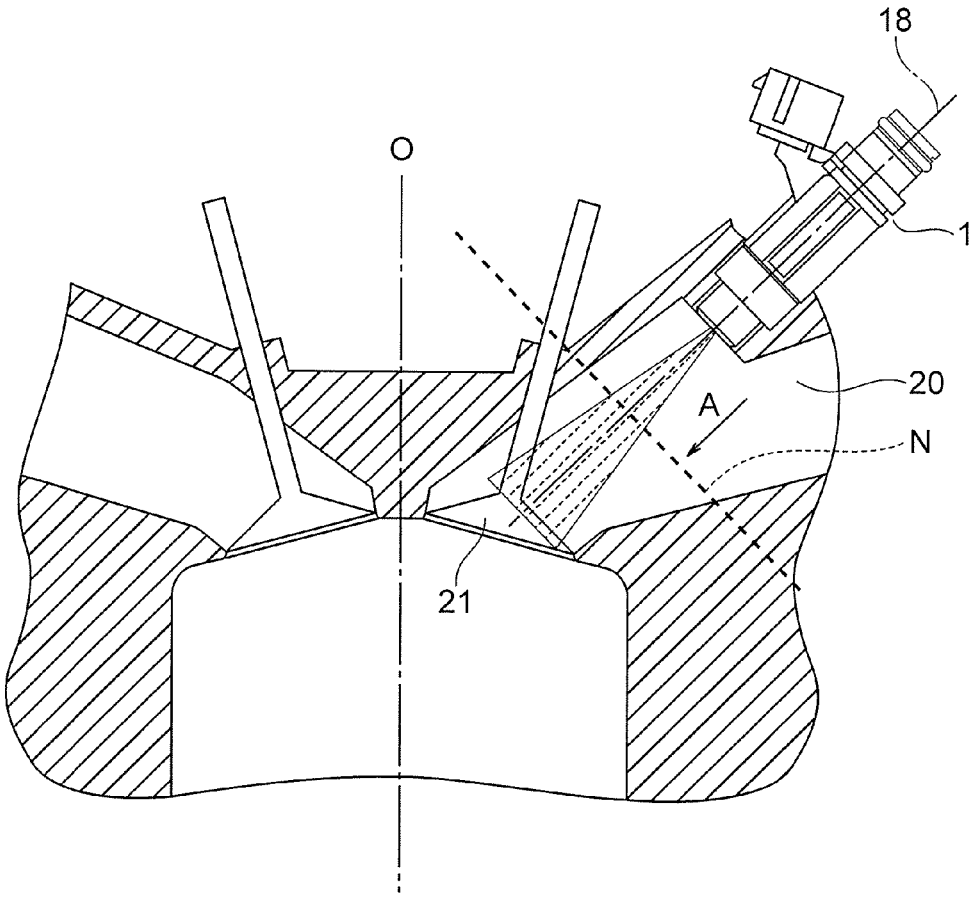
FIG. 5 is a sectional view illustrating a state in which the fuel injection valve illustrated in FIG. 1 is installed.
Figure 6:
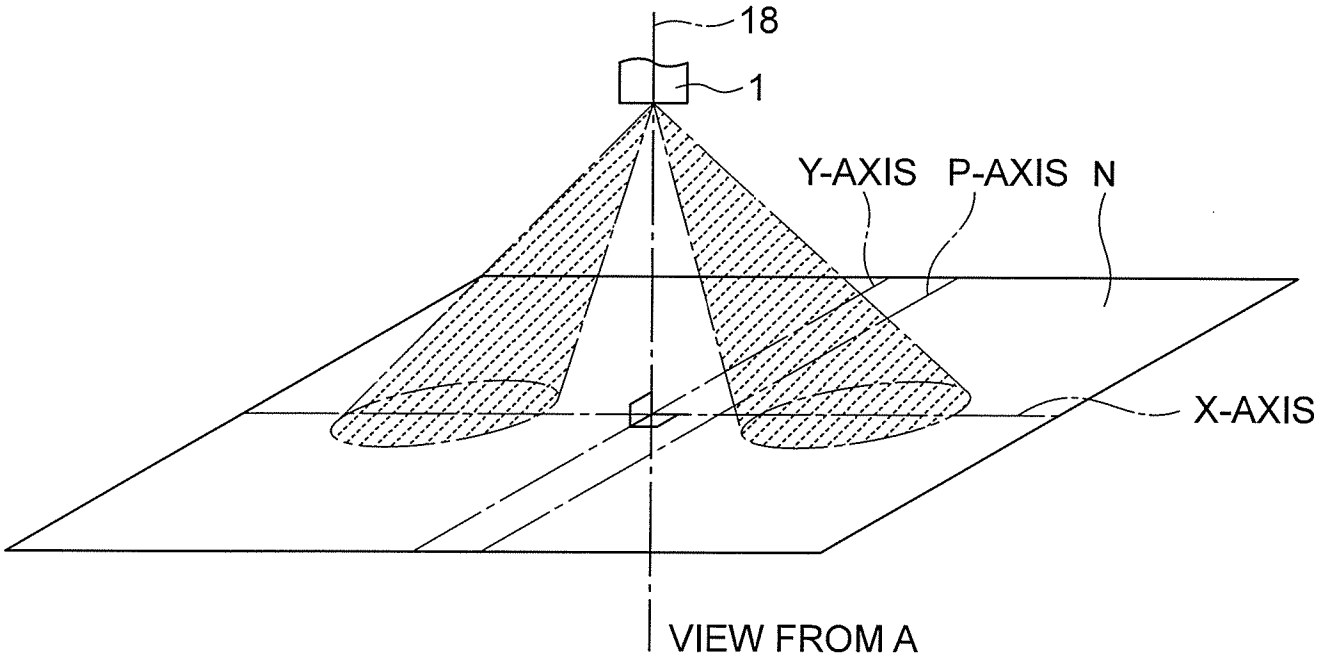
FIG. 6 is a perspective view illustrating an X-Y plane N as viewed from a direction indicated by the arrow A in FIG. 5.

FIG. 5 is a sectional view illustrating a state in which the fuel injection valve 1 is installed to the engine intake pipe 20. FIG. 6 is a perspective view illustrating an X-Y plane N as viewed from a direction indicated by the arrow A in FIG. 5.

In FIGS. 2 to 4, the X axis and the Y axis are defined by using a center of the injection-hole plate 11, which coincides with a valve-seat axial center 18, as a reference. An inter-injection hole angle θ and straight lines a to e in the X-Y plane are defined. Fuel flows 16*a*, 16*b*, 16*xa*, 16*ya*, 16*xb*, 16*yb*, 16*d*, and 16*e* in the respective directions, a swirl flow 16*c*, and an injection direction 16*f* are clearly illustrated.

In FIG. 5, a cross section of a single cylinder is illustrated. However, the fuel injection valve 1 to be installed to the engine intake pipe 20 is used for the combination of the two intake valves 21 (combination with an intake valve of another cylinder (not shown)) and the single fuel injection valve 1.

In FIG. 6, the X-Y plane N that is located in the injection direction 16*f* for the fuel injection valve 1 is defined.

In FIGS. 2 to 4, the injection-hole plate 11 having the plurality of injection holes 12 formed therein is mounted onto a downstream-side end surface 10*b* of the valve seat 10 having the reduced diameter toward the downstream side, while a cavity 15 that brings a valve-seat opening inner wall 10*c* and the injection holes into communication with each other is formed in the downstream-side end surface 10*b*.

The plurality of injection holes 12 are formed on the radially outer side of the valve-seat opening inner wall 10*c* that is a minimum inner diameter of the valve seat 10.

On a downstream-side end surface 11*b* of the injection-hole plate 11, concave portions 17, each having a larger opening area than that of the injection hole 12, are formed on a one-to-one basis with respect to the injection holes 12.

A center 17*a* of each of the concave portions 17 is arranged on the plane N (see FIG. 6) on the radially outer side of the straight light e, which passes through the center of an injection-hole outlet 12*b* and is perpendicular to the straight line c, with respect to a valve-seat axial center 18.

The concave portion 17 is arranged so that a region in which a length of the injection hole 12 is short is larger on the injection direction 16*f* side than on the opposite side with respect to the straight line c.

In FIGS. 5 and 6, a straight line obtained by projecting a cylinder central axis O of an engine onto the plane N that is perpendicular to the valve-seat axial center 18 is a P-axis, a straight line that passes through the valve-seat axial center 18 and is perpendicular to the P-axis is an X-axis, and a straight line that is parallel to the P-axis is a Y-axis.

In this case, when injection-hole inlets 12*a* and the injection-hole outlets 12*b* of the plurality of injection holes 12 are projected vertically onto the plane N and any one of the injection holes 12 is set as a reference injection hole 12*c*, an angle formed by the straight line a passing through a center of the injection hole inlet of the reference injection hole 12*c* and the valve-seat axial center 18 and the straight line b passing through a center of an injection hole inlet of an injection hole 12*d* that neighbors the reference injection hole and the valve-seat axial center 18, specifically, an inter-injection hole angle θ is reduced as being closer to the Y-axis.

In the first embodiment of the present invention, as illustrated in FIGS. 2 to 4, when the injection hole that is the closest to the Y-axis among the injection holes 12 arranged on the right side of the Y-axis is set as the reference injection hole 12*c*, a relationship between an inter-injection hole angle $\theta_1$ on the X-axis side of the reference injection hole 12*c* and an inter-injection hole angle $\theta_2$ on the Y-axis side thereof satisfies "$\theta_2<\theta_1$".

In this manner, when the valve element 8 is opened, the fuel 16 flows from the valve-seat opening inner wall 10*c* into the cavity 15 to radially spread toward the radially outer side with respect to the valve-seat axial center 18.

At this time, as the fuel flow 16*a* toward the injection hole 12, the fuel flow 16*b* (fuel main flow) flowing from the valve-seat axial center 18 toward the center of each of the injection holes 12, the fuel flow 16*xa* flowing from the X-axis side of the fuel main flow 16*b* toward the center of each of the injection holes 12, and the fuel flow 16*ya* flowing from the Y-axis side toward the center of each of the injection holes 12 are formed.

In this case, the inter-injection hole angle θ has the relationship "$\theta_2<\theta_1$". Therefore, nonuniformity in the flow occurs between the fuel flow 16*xa* and the fuel flow 16*ya* with respect to the reference injection hole 12*c*.

The fuel flow 16*xa* has the large inter-injection angle θ and therefore turns at a wide angle in the cavity 15 to flow into each of the injection holes 12 from the direction 16*xb* that is substantially perpendicular.

On the other hand, the fuel flow 16*ya* has the small inter-injection hole angle θ and becomes the fuel flow 16*yb* that flows in a substantially parallel direction to the fuel main flow 16*b* to flow into a position apart from the center of the injection hole inlet, such as an edge of the injection hole 12, which is to flow along an injection-hole inner wall surface 12*e*. As a result, the swirl flow 16*c* is formed by the fuel main flow 16*b* and the fuel flow 16*yb* inside the injection hole 12.

Further, by pressing the swirl flow 16*c* against the injection-hole inner wall surface 12*e* on the radially outer side of the valve-seat axial center 18 with the fuel flow 16*xb* that is to flow into the injection hole 12 from the direction that is substantially perpendicular, the fuel 16 can be formed into a thinner film.

Moreover, in the plane N, in an angle formed by the straight line a and the straight line c passing through the center of the injection-hole inlet 12*a* and the center of the injection-hole outlet 12*b*, a wide-angle side angle, that is, a fuel turn angle α has a relationship "$90°<\alpha<180°$".

When the fuel turn angle α becomes equal to or smaller than 90° ($\alpha\leq 90°$), the swirl flow 16*c*, which is formed by the fuel main flow 16*b* and the fuel flow 16*yb*, and the fuel flow 16*xb* cause a head-on collision in the injection hole 12 to inhibit the formation of the swirl flow 16*c*.

Moreover, when the fuel turn angle α becomes equal to or larger than 180° ($180°\leq\alpha$), the fuel flow 16*yb* separates away at the injection-hole inlet 12*a*. As a result, the swirl flow 16*c* cannot be formed in the injection hole 12.

Therefore, by setting the fuel turn angle α within the range of "$90°<\alpha<180°$", the formation of the swirl flow 16 in the injection hole 12 can be reinforced. As a result, the formation of the fuel 16 into the thinner film can be promoted.

Moreover, in the first embodiment of the present invention, when an angle formed by the straight line a and the straight line d passing through the center of the injection hole inlet 12*a* in parallel to the X-axis on the plane N is an injection-hole arrangement angle β, a relationship "$\beta\leq\alpha$" is satisfied.

As a result, the fuels injected from the respective injection holes 12 can be prevented from colliding against each other before the fuel liquid film breaks up into the droplets to avoid turbulence caused in the liquid film to inhibit the atomization.

Moreover, the concave portions 17, each having a larger opening area than that of each of the injection holes 12, are formed on the downstream-side end surface 11*b* of the injection-hole plate 11 on a one-to-one basis with respect to the injection holes 12. The center 17*a* of each of the concave portions 17 is arranged on the plane N so as to be closer to the radially outer side of the valve-seat axial center 18 than the straight line e passing through the center of the injection hole outlet 12*b* and being perpendicular to the straight line c.

Moreover, the concave portion 17 is arranged so that the region in which the injection-hole length is short is larger on the injection direction 16*f* side than on the opposite side with respect to the straight line c.

In this manner, the swirl flow 16*c* is formed in the injection hole 12. In the fuel 16 pressed against the injection-hole inner wall surface 12*e*, the fuel flow 16*d* spreading in the injection direction 16*f* is injected in a direction in which the concave portion 17 is open because there is no injection-hole inner wall in the concave portion 17.

On the other hand, for the fuel flow 16*e* spreading in the direction opposite to the injection direction 16*f*, the injection-hole inner wall surface 12*e* and a concave-portion inner wall surface 17*b* are in connection with each other and therefore the wall surface continues to the injection-hole outlet 12*b*.

Therefore, the direction of the fuel 16 can be changed to the desired injection direction 16*f* while the flow along curvatures of the injection hole 12 and the concave portion 17 is formed. Therefore, an angle of a spray aggregate can be prevented from being wider while a single spray angle of the swirl flow 16*c* increases.

Moreover, the injection hole diameter increases in the concave portion 17. Therefore, the liquid film that is pressed against the injection-hole inner wall surface 12*e* to be formed into the thinner film is further spread into the thinner film. Thus, the atomization can be promoted.

In the first embodiment described above, the case of the combination of the two intake valves 21 and the single fuel injection valve 1 has been described. However, the combination is not limited thereto. A combination of the single intake valve 21 and the single fuel injection valve 1, a combination of the two intake valves 21 and the two fuel injection valves 1, or a combination of the single intake valve 21 and the two fuel injection valves 1 may also be used.

Moreover, the configuration example in which the cavity 15 is formed by concaving the valve seat 10 on the downstream-side end surface 10*b* of the valve seat 10 as illustrated in FIG. 2 has been described. However, the cavity 15 may be formed by concaving the injection-hole plate 11 on an upstream-side end surface 11*c* of the injection-hole plate 11.

Moreover, the case where the number of injection holes 12 formed through the injection-hole plate 11 is eight has been described. However, the number of injection holes 12 is not necessarily limited to eight as long as one or more spray aggregate can be formed. This also applies to second to eighth embodiments described below.

As described above, the fuel injection valve 1 according to the first embodiment (FIGS. 1 to 6) of the present invention includes the valve seat 10 having the valve-seat seating surface 10*a* arranged on the open end of the fuel injection valve 1, the valve element 8 for opening and closing the valve seat 10, that is arranged so as to be opposed to the valve seat 10, and the injection-hole plate 11 having the plurality of injection holes 12, which is mounted on the downstream side of the valve seat 10, and is configured to operate the valve element 8 in the valve-opening direction in response to the operation signal from the engine control unit to allow the fuel 16 to pass between the valve element 8 and the valve-seat seating surface 10*a* to inject the spray aggregate from the plurality of injection holes 12 toward the intake valve 21.

The plurality of injection holes 12 are formed on the radially outer side of the valve-seat opening inner wall 10*c* that is the minimum inner diameter of the valve seat 10 having the diameter reduced toward the downstream side. On the downstream-side end surface of the valve seat 10, the cavity 15 that brings the valve-seat opening inner wall 10*c* and the plurality of injection holes 12 into communication is provided.

Moreover, when the straight line obtained by projecting the cylinder central axis O of the engine onto the plane N that is perpendicular to the valve-seat axial center 18 is the P-axis, the straight line passing through the valve-seat axial center 18 and being perpendicular to the P-axis on the plane N is the X-axis, the straight line parallel to the P-axis is the Y-axis, and one of the plurality of injection holes 12 projected onto the plane N is the reference injection hole 12*c* in the case where the injection-hole inlets 12*a* and the injection-hole outlets 12*b* of the plurality of injection holes 12 are projected vertically onto the plane N, the inter-injection hole angle θ formed on the plane N by the straight line a passing through the center of the injection-hole inlet of the reference injection hole 12*c* and the valve-seat axial center 18 and the straight line b passing through the center of the injection-hole inlet of the injection hole neighboring the reference injection hole 12*c* and the valve-seat axial center 18 is set so as to be smaller as being closer to the Y-axis.

Moreover, on the plane N, in the angle formed by the straight line a and the straight line c passing through the center of the injection-hole inlet 12*a* and the center of the injection-hole outlet 12*b*, the fuel turn angle α on the wide angle side satisfies the relationship: $90° < \alpha < 180°$.

Further, the concave portions 17, each having the larger opening area than that of each of the injection holes 12, are formed on the down-stream end surface of the injection-hole plate 11 on a one-to-one basis with respect to the injection holes 12. The concave portion 17 is arranged so that the region in which the injection-hole length is short becomes larger on the side of the desired injection direction than on the opposite side with respect to the straight line c.

According to the fuel injection valve 1 having the configuration described above, when the valve is opened, the fuel 16 flows from the valve-seat opening inner wall 10*c* into the cavity 15 to spread radially to the radial outer side with respect to the valve-seat axial center 18. At this time, as the fuel flow toward the injection hole 12, the fuel main flow 16*b* flowing from the valve-seat axial center 18 toward the center of the injection hole 12, the fuel flow 16*xa* flowing toward the injection hole 12 from the X-axis side with respect to the fuel main flow 16*b*, and the fuel flow 16*ya* flowing from the Y-axis side toward the injection hole 12 are formed.

Moreover, the inter-injection hole angle θ between the plurality of injection holes 12 formed in the injection-hole plate 11 is reduced as being closer to the Y-axis. Therefore, the fuel flow 16*xa* turns at a wide angle in the cavity 15 to flow into the injection hole 12 from the direction 16*xb* that is substantially perpendicular.

On the other hand, the fuel flow 16*ya* from the Y-axis side on which the inter-injection hole angle θ is smaller than on the X-axis side becomes the fuel flow 16*yb* substantially parallel to the fuel main flow 16*b*, which flows into the position away from the center of the injection-hole inlet such as the edge of the injection hole to flow along the injection-hole inner wall surface 12*e*.

As a result, by the fuel main flow 16*b* flowing toward the center of the injection-hole inlet 12*a* and the fuel flow 16*yb* flowing to the edge of the injection hole 12 to flow along the injection-hole inner wall surface 12*e*, the swirl flow 16*c* can be formed in the injection hole 12.

Further, by pressing the swirl flow 16*c* against the injection-hole inner wall surface 12*e* on the radially outer side of the valve-seat axial center 18 with the fuel flow 16*xb* that is to flow into the injection hole 12 from the direction that is substantially perpendicular, the fuel 16 can be formed into the thinner film.

Moreover, when the fuel turn angle α is: $\alpha \leq 90°$, the head-one collision between the swirl flow 16*c* formed by the fuel main flow 16*b* and the fuel flow 16*yb* and the fuel flow 16*xb* is caused in the injection hole 12 to inhibit the formation of the swirl flow 16*c*. On the contrary, when $180° \leq \alpha$ is satisfied, the fuel flow 16*yb* separates away at the injection-hole inlet 12*a* portion. Therefore, the formation of the swirl flow 16*c* becomes impossible. By setting the fuel turn angle α within the range of: $90° < \alpha < 180°$, the swirl flow 16*c* can be reinforced in the injection hole 12. As a result, the formation of the fuel 16 into the thinner film can be promoted.

Thus, the fuel injection valve 1 that realizes both the atomization and the aggregation of the sprays at low costs while restricting a variation in flow-rate characteristics can be obtained.

In the case where the injection is performed after pressing the swirl flow 16*c* against the injection-hole inner wall surface 12*e* on the radially outer side of the valve-seat axial center 18, the liquid film becomes thinner to promote the atomization as the pressing of the fuel 16 against the injection-hole inner wall surface 12*e* becomes stronger. However, the injected fuel tends to spread radially outward with respect to the valve-seat axial center 18. As a result, the spray angle of the spray aggregate becomes larger to increase the amount of spray adhering to the inner wall of the intake port that is in communication with the engine intake pipe 20. As a result, the amount of fuel flowing along the inner wall of the intake port to become the liquid film flowing into a combustion chamber increases. Therefore, there is a possibility that an incomplete combustion occurs in the combustion chamber to lower combustion efficiency.

On the other hand, in the first embodiment of the present invention, the concave portions 17 are formed on the downstream-side end surface of the injection-hole plate 11 so as to correspond to the injection holes 12 on a one-to-one basis. Moreover, the concave portions 17 are arranged so that the region in which the injection-hole length is short becomes larger on the side of the desired injection direction than on the opposite side with respect to the straight line obtained by connecting the center of the injection-hole inlet and the center of the injection-hole outlet that are projected vertically on the plane N perpendicular to the valve-seat axial center 18.

Therefore, by controlling the injection direction of the fuel with the concave portions 17, the angle of the spray can be prevented from being wider to enable the reduction of the amount of spray adhering to the inner wall of the intake port. Thus, the combustion efficiency can be improved.

Moreover, by adding the concave portions 17, a larger opening area than that of the injection holes 12 can be ensured on the downstream side of the injection holes 12. Thus, the flow of the fuel pressed against the injection-hole inner wall surface 12*e* to be formed into the thinner film becomes the flow along the curvatures of the injection holes 12 and the concave portions 17 because the injection-hole diameter is increased at the concave portions 17. As a result, the liquid film is further spread into the thinner film. Thus, the atomization can be promoted.

Second Embodiment

Although not particularly mentioned in the first embodiment described above, a distance r from the edge of the injection-hole inlet 12*a*, which is on the radially outer side of the valve-seat axial center 18, to the cavity inner wall 15*a* desirably satisfies the relationship: "$\varphi<r$" for a diameter $\varphi$ of each of the injection holes 12 formed through the injection-hole plate 11, as illustrated in FIG. 2.

When it is supposed that the relationship between the diameter $\varphi$ and the distance r is "$r\leq\varphi$", the distance between the injection hole 12 and the cavity inner wall 15*a* cannot be sufficiently ensured. Therefore, when the valve element 8 (see FIG. 1) is opened, the fuel 16 flowing from the valve-seat opening inner wall 10*c* into the cavity 15 spreads radially outward with respect to the valve-seat axial center 18 to pass between the injection holes 12. Thereafter, the fuel 16 collides against the cavity inner wall 15*a* to become a flow along the cavity inner wall 15*a*.

As a result, the fuel 16 flows to the edge of the injection hole 12 from various directions, thereby inhibiting the formation of the swirl flow 16*c* (see FIG. 4) in the injection hole 12.

Therefore, in the second embodiment of the present invention, it is assumed that a circle formed by projecting the cavity inner wall 15 vertically onto the plane N is a virtual circle and the distance r on the straight line a from the edge of the injection-hole inlet 12*a*, which is on the radially outer side of the valve-seat axial center 18, and the diameter $\varphi$ of the injection hole 12 satisfies the relationship: $\varphi<r$.

Specifically, by setting the relationship between the diameter $\varphi$ and the distance r to "$\varphi<r$", the swirl flow 12*c* in the injection hole 12 can be reinforced. As a result, the formation of the fuel into the thinner film can be promoted.

Third Embodiment

Although not particularly mentioned in the first embodiment described above, a height h immediately above the injection hole, which is represented by a distance between the center of the injection-hole inlet 12*a* and the cavity 15 in the direction of the valve-seat axial center 18, desirably satisfies a relationship "$h<\varphi$" for the diameter $\varphi$ of the injection hole 12, as illustrated in FIG. 2.

When it is assumed that the relationship between the diameter $\varphi$ and the height h immediately above the injection hole is "$\varphi\leq h$", the fuel 16 flows from immediately above the injection hole 12 toward the injection hole 12. Thus, the swirl flow 16*c* (see FIG. 4) in the injection hole 12 cannot be reinforced.

Therefore, in the third embodiment of the present invention, the height h immediately above the injection hole, which is represented by the center of the injection-hole inlet 12*a* and the cavity 15 in the direction of the valve-seat axial center 18, satisfies the relationship: $h<\varphi$.

As a result, when the valve element 8 (see FIG. 1) is opened, the fuel flow spreading radially outward with respect to the valve-seat axial center 18 can be effectively used after flowing from the valve-seat opening inner wall 10*c* into the cavity 15. Thus, the swirl flow 16*c* in the injection hole 12 can be reinforced. As a result, the formation of the fuel 16 into the thinner film can be promoted.

Fourth Embodiment

Figure 7:
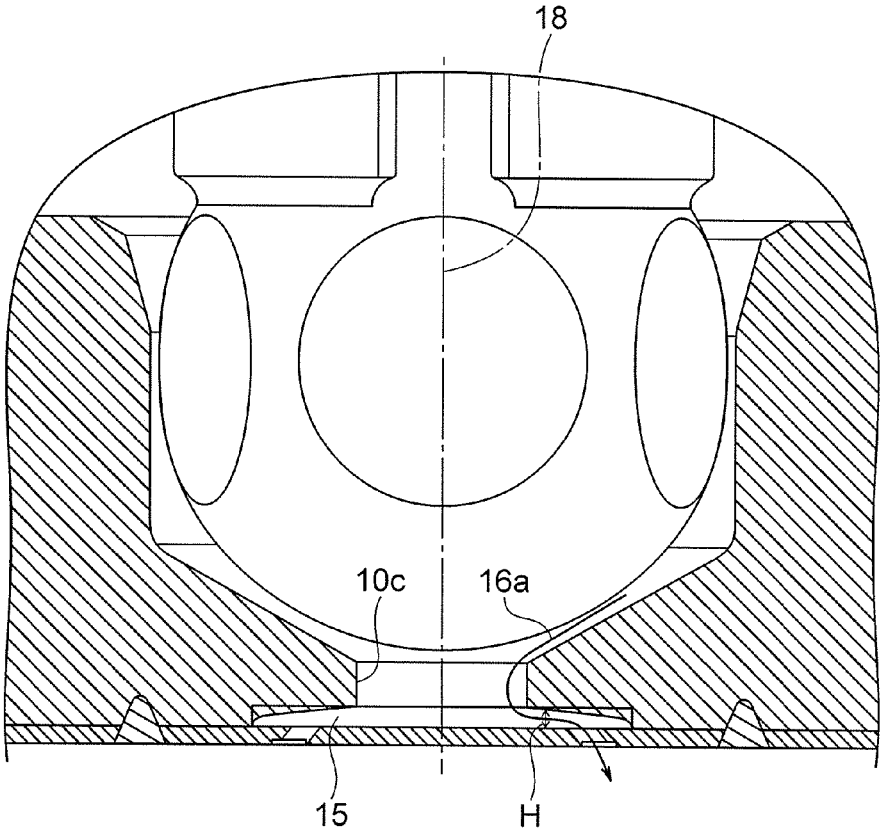
FIG. 7 is a sectional view illustrating a distal end portion of a fuel injection valve according to a fourth embodiment of the present invention in an enlarged manner.

Although a sectional shape of the cavity 15 is rectangular in the first to third embodiments (FIG. 2) described above, the cavity 15 may be configured to have a tapered shape, as illustrated in FIG. 7.

FIG. 7 is a sectional view illustrating the distal end portion of the fuel injection valve 1 according to a fourth embodiment of the present invention in an enlarged manner. Only the shape of the cavity 15 is different from that described above.

In FIG. 7, the cavity 15 has the tapered shape so that a height H in the direction of the valve-seat axial center 18 is reduced toward the outer circumferential side.

In this manner, as compared with the case where the height h in the direction of the valve-seat axial center 18 is constant (FIG. 2), a flow-path area in the cavity 15 can be reduced toward the outer circumferential side. Therefore, a reduction in flow velocity of the fuel flow 16*a* spreading radially outward from the valve-seat opening inner wall 10*c* can be restricted.

As a result, the flow 16 can flow into the injection hole 12 while keeping the high flow velocity. Therefore, the swirl flow 16*c* (see FIG. 4) can be reinforced. Thus, the atomization can be further promoted.

Fifth Embodiment

Figure 8:
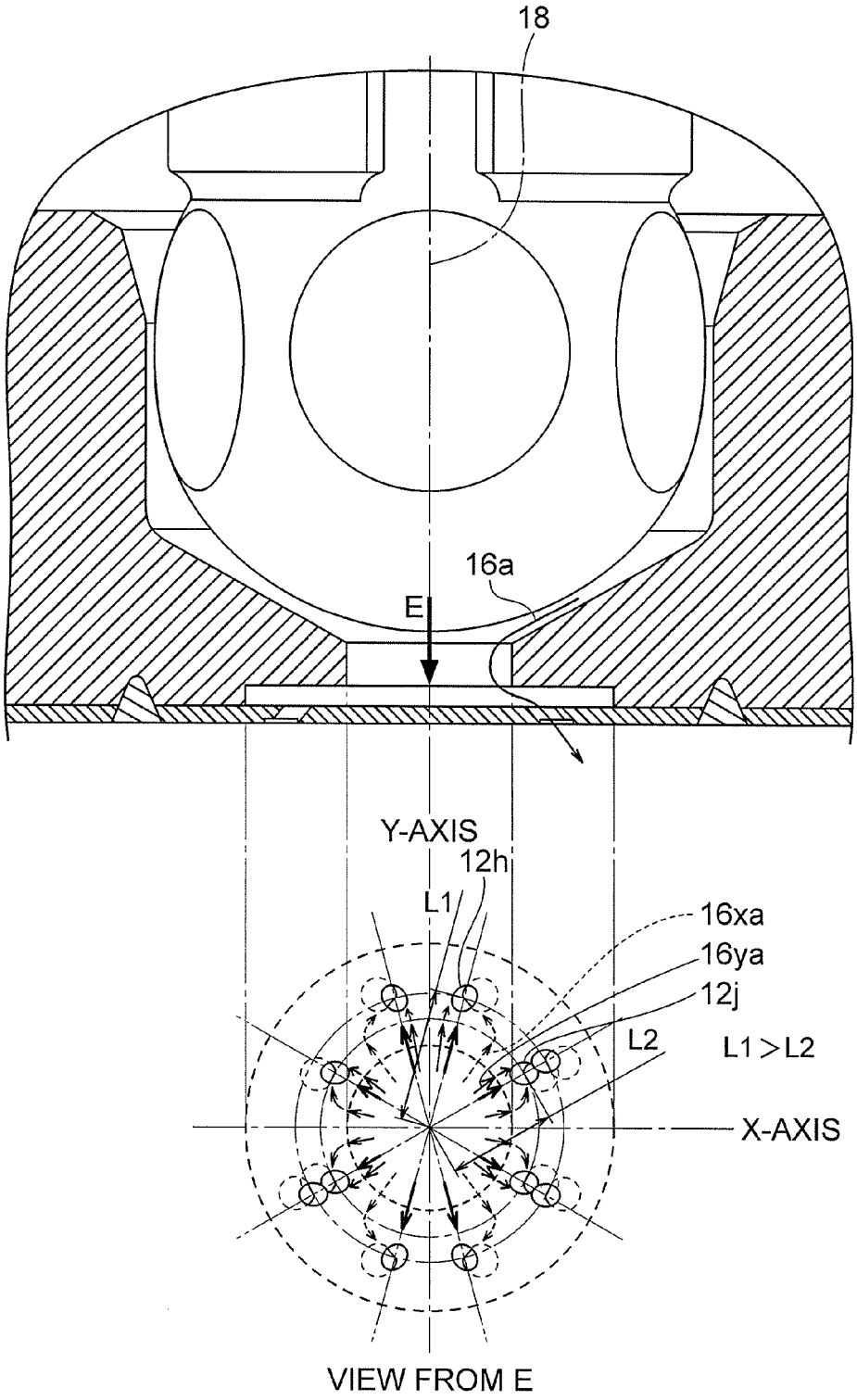
FIG. 8 is a sectional view and a plan view illustrating a distal end portion of a fuel injection valve according to a fifth embodiment of the present invention in an enlarged manner.

Although the distance from the valve-seat axial center 18 to the center of each of the injection-hole inlets is set constant on the plane N in the first to third embodiments (FIG. 2) described above, the distance may be set so as to be shorter as being closer to the X-axis, as illustrated in FIG. 8.

FIG. 8 is a sectional view and a plan view illustrating the distal end portion of the fuel injection valve 1 according to a fifth embodiment of the present invention in an enlarged manner. Only the arrangement of injection holes 12*h* and 12*j* on the plan view is different from that described above.

The plan view of FIG. 8 illustrates a state as viewed from a direction indicated by the arrow E in the sectional view of FIG. 8.

In FIG. 8, the four injection holes 12 are formed through the injection-hole plate 11 on each side of the Y-axis in a symmetrical manner. As a result, the fuel injection valve 1 has a configuration of injecting the spray aggregates in two directions, specifically, to the right and left, with respect to the Y-axis as a center.

Here, the spread of the spray in the X-axis direction is defined as "front spray" and the spread of the spray in the Y-axis direction is defined as "side spray".

In this case, among the four injection holes 12 on each of the right and the left sides, it is two injection holes 12*j* on each of the right and the left sides, which are closer to the X-axis, that form the radially outward spray with respect to the valve-seat axial center 18 in the direction of the "front spray".

On the other hand, it is the two injection holes 12*h* on each of the right and left sides that form the radially outer spray with respect to the valve-seat axial center 18 in the direction of the "side spray".

In this manner, the sprays injected from the injection holes 12 interfere with each other to form the spray aggregates.

In this case, when the injection holes 12 are arranged at equal intervals from the valve-seat axial center 18 (center of the injection-hole plate 11) as described above, a density of the spray becomes higher in the region where the sprays interfere with each other. Therefore, there is a possibility that vaporizability of the fuel 16 is lowered when the fuel 16 adheres to the intake valve 21.

Therefore, in the fifth embodiment of the present invention, the distance from the valve-seat axial center 18 to the center of each of the injection-hole inlets is set on the plane N so as to become shorter as being closer to the X-axis.

Specifically, for an inter-center distance from the valve-seat axial center 18 to the center of each of the injection-hole inlets, an inter-center distance L2 to each of the two injection holes 12*j* on each of the right and left sides, which are closer to the X-axis, is configured to be shorter than an inter-center distance L1 to each of the two injection holes 12*h* on each of the right and left sides, which are closer to the Y-axis.

In this manner, the fuel 16 flowing between the injection hole 12*j* on the X-axis side and the injection hole 12*h* on the Y-axis side is to flow into the injection hole 12*j* on the X-axis side, which is closer to the valve-seat opening inner wall 10*c*, while keeping a high flow velocity. Therefore, the fuel flow 16*ya* to the injection hole 12*j* on the X-axis side is reinforced, while the fuel flow 16*xa* to the injection hole 12*h* on the Y-axis side is weakened.

As a result, in the injection holes 12*h*, which are closer to the Y-axis, the swirl flow 16*c* (see FIG. 4) becomes weaker to degrade the atomization. In the injection holes 12*j* on the X-axis side, however, the swirl flow 16*c* is reinforced to promote the atomization. As a result, the spray having an extremely small particle diameter can be injected.

Therefore, even in the case where the injection direction of the front spray is spread toward the intake port inner wall in order to avoid the interference between the sprays injected from the respective injection holes 12, the particle diameter injected toward the injection port inner wall can be made extremely small and reduced in weight. Therefore, the spray is carried by the flow of an intake air inside the intake port so as to be unlikely to adhere to the intake port inner wall.

Moreover, even when the fuel 16 adheres to the intake port inner wall, the fuel 16 can be quickly vaporized because of the extremely small particle diameter. Therefore, the spray density in the region where the sprays injected from the injection holes 12 interfere with each other is lowered to improve the vaporizability of the fuel. Thus, the combustion efficiency can be improved.

Sixth Embodiment

Although the distance from the valve-seat axial center 18 to the center of each of the injection-hole inlets is set so as to be shorter as being closer to the X-axis on the plane N in the fifth embodiment (FIG. 8) described above. On the contrary, the distance may be set so as to be shorter as being closer to the Y-axis, as illustrated in FIG. 9.

Figure 9:
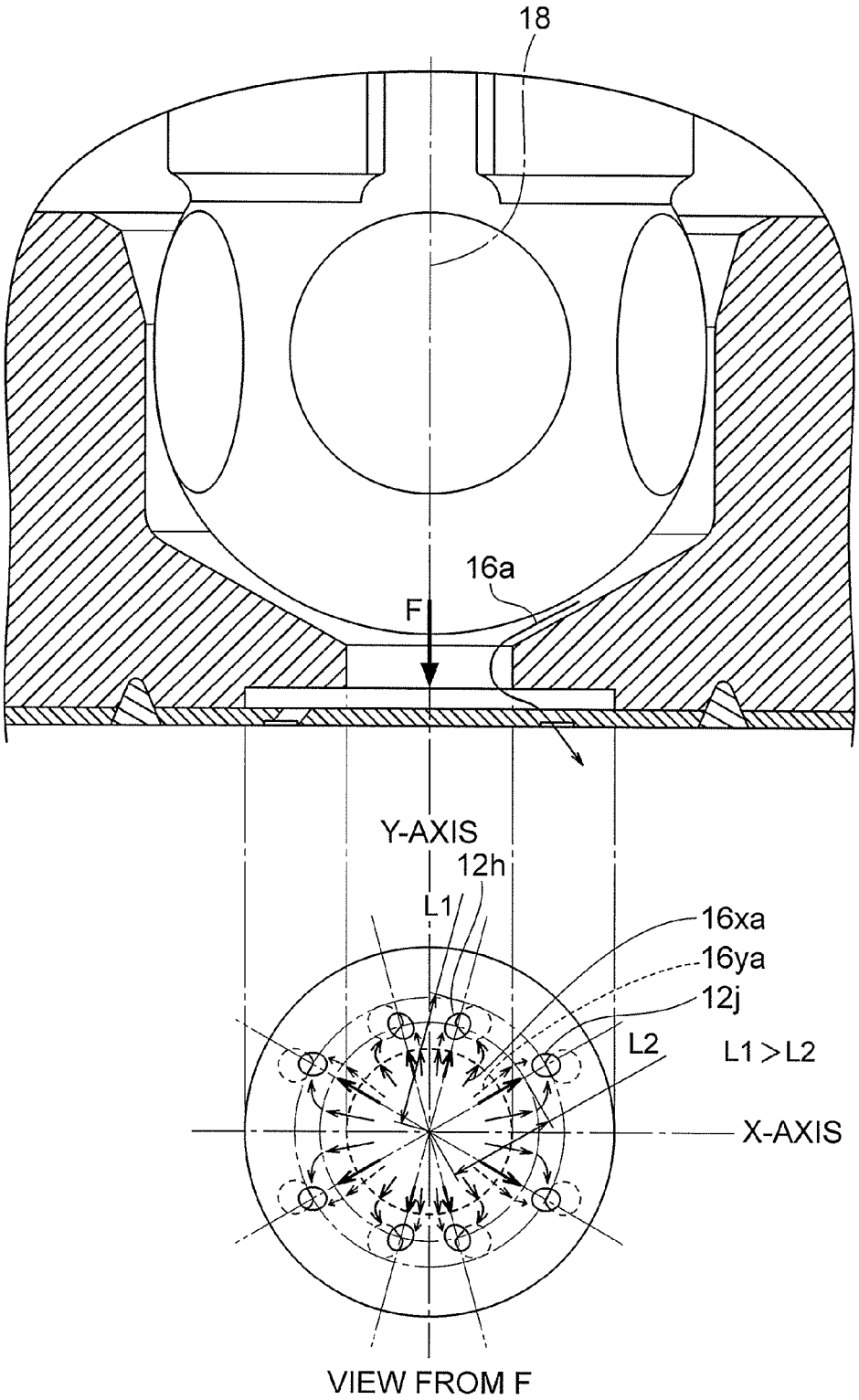
FIG. 9 is a sectional view and a plan view illustrating a distal end portion of a fuel injection valve according to a sixth embodiment of the present invention in an enlarged manner.

FIG. 9 is a sectional view and a plan view illustrating the distal end portion of the fuel injection valve 1 according to a sixth embodiment of the present invention in an enlarged manner. Only the arrangement relationship of the injection holes 12*h* and 12*j* on the plan view is set conversely to that described above (FIG. 8).

The plan view of FIG. 9 illustrates a state as viewed from a direction indicated by the arrow F in the sectional view of FIG. 9.

In FIG. 9, an inter-center distance L1 to each of the two injection holes 12*h* on the right and left sides, which are closer to the Y-axis, is set shorter than an inter-center distance L2 to each of the two injection holes 12*j* on the right and left sides, which are closer to the X-axis.

In this manner, the fuel 16 flowing between the injection hole 12*j* on the X-axis side and the injection hole 12*h* on the Y-axis side is to flow into the injection hole 12*h* on the Y-axis side, which is closer to the valve-seat opening inner wall 10*c*, while keeping a high flow velocity. Therefore, the fuel flow 16*xa* to the injection hole 12*h* on the Y-axis side is reinforced. On the contrary, the fuel flow 16*ya* to the injection hole 12*j* on the X-axis side is weakened.

As a result, in the injection holes 12*j*, which are closer to the X-axis, the swirl flow 16*c* (see FIG. 4) becomes weaker to degrade the atomization. In the injection holes 12*h* on the Y-axis side, however, the swirl flow 16*c* is reinforced to promote the atomization. As a result, the spray having an extremely small particle diameter can be injected.

Therefore, even in the case where the injection direction of the side spray is spread toward the intake port inner wall in order to avoid the interference between the sprays injected from the respective injection holes 12, the particle diameter injected toward the injection port inner wall can be made extremely small and reduced in weight. Therefore, the spray is carried by the flow of the intake air inside the intake port so as to be unlikely to adhere to the intake port inner wall.

Moreover, even when the fuel 16 adheres to the intake port inner wall, the fuel 16 can be quickly vaporized because of the extremely small particle diameter. Therefore, the spray density in the region where the sprays injected from the injection holes 12 interfere with each other is lowered to improve the vaporizability of the fuel. Thus, the combustion efficiency can be improved.

Seventh Embodiment

Figure 10:
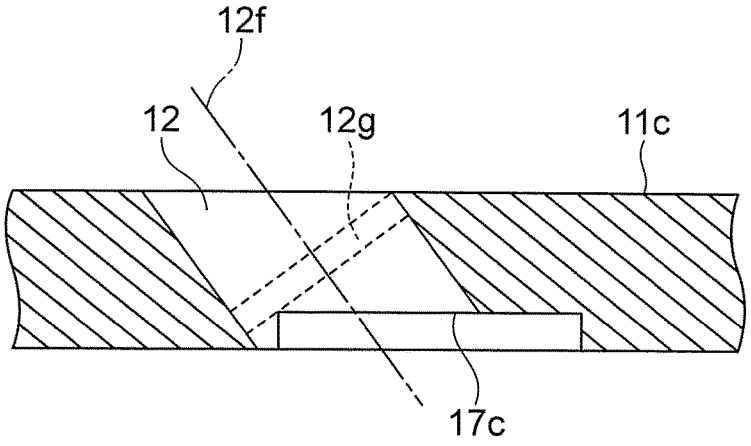
FIG. 10 is a sectional view illustrating an injection hole portion of a fuel injection valve according to a seventh embodiment of the present invention in an enlarged manner.

Although not particularly mentioned in the first to sixth embodiments described above, a cylindrical portion 12*g* having a minimum area in a radial direction of the injection hole 12 as a cross section is desirably ensured between the upstream-side end surface 11*c* of the injection-hole plate 11 and a concave-portion bottom surface 17*c* when a plane that is perpendicular to a central axis 12*f* of the injection hole 12 is a cross section in the flow path of the injection hole 12, as illustrated in FIG. 10.

FIG. 10 is a sectional view illustrating the injection hole portion of the fuel injection valve 1 according to a seventh embodiment of the present invention in an enlarged manner.

In the flow path of the injection hole 12 illustrated in FIG. 10, when the plane that is perpendicular to the central axis 12*f* of the injection hole 12 is the cross section (circular cross section in this case), the cylindrical portion 12*g* having the minimum area in the radial direction of the injection hole 12 as the cross section is ensured between the upstream-side end surface 11*c* of the injection-hole plate 11 and the concave-portion bottom surface 17*c*.

Specifically, when the concave-portion bottom surface 17*c* comes too close to the upstream-side end surface 11*c* of the injection-hole plate 11 to prevent the cylindrical portion 12*g* from being ensured, a substantial opening area of the injection hole 12 enlarges to increase the flow rate. Thus, the concave portion 17 is formed within the range in which such a situation can be avoided.

In FIG. 10, the flow rate of the fuel 16 passing through the injection hole 12 is determined by the sectional area of the cylindrical portion 12*g* that is ensured in the injection hole 12 and therefore is stabilized to a constant amount.

Thus, the atomization of the spray can be promoted while restricting a variation in flow rate due to a positional variation between the injection hole 12 and the concave portion 17.

Eighth Embodiment

Figure 11:
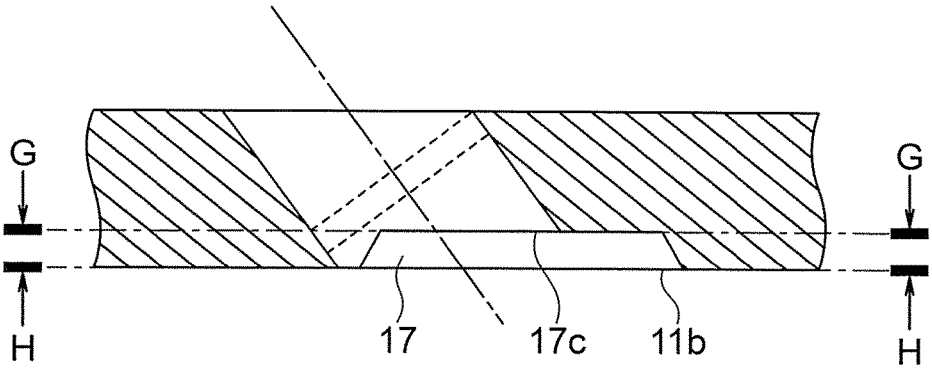
FIG. 11 is a sectional view illustrating an injection hole portion of a fuel injection valve according to an eighth embodiment of the present invention in an enlarged manner.

Although the sectional shape of the concave portion 17 is rectangular in the first to seventh embodiments (FIGS. 1 to 10) described above, an area of the concave portion 17, which is open on the downstream-side end surface 11*b* of the injection-hole plate 11, is desirably configured to be larger than an area of the concave-portion bottom surface 17*c* as a trapezoidal shape, as illustrated in FIG. 11.

Figure 12:
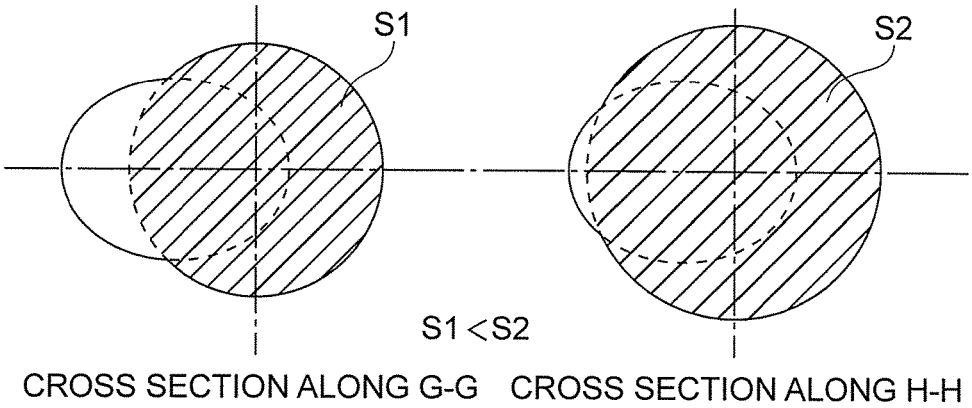
FIG. 12 is a sectional view taken along the line G-G and the line H-H in FIG. 11.
Figure 13:
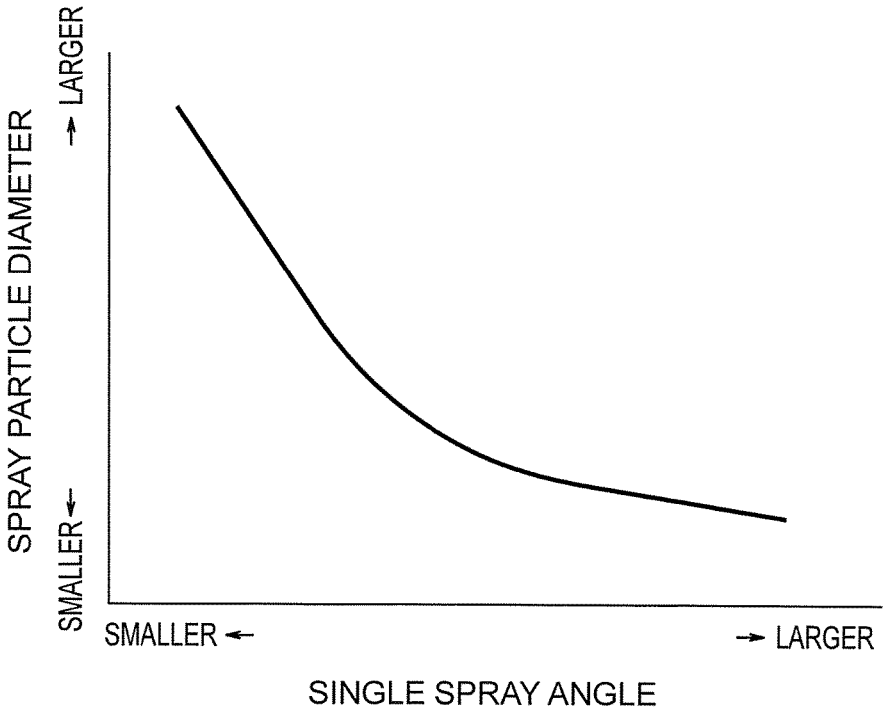
FIG. 13 is an explanatory diagram illustrating a relationship between a general single spray angle and a particle diameter.

FIG. 11 is a sectional view illustrating the injection hole portion of the fuel injection valve 1 according to an eighth embodiment of the present invention in an enlarged manner. Only a sectional shape of the concave portion 17 is different from that described above. FIG. 12 is a sectional view taken along the line G-G and the line H-H in FIG. 11.

In FIGS. 11 and 12, the concave portion 17 is configured so that an opening area S2, which is open on the downstream-side end surface 11*b* of the injection-hole plate 11, becomes larger than a bottom-surface area S1 of the concave-portion bottom surface 17*c*.

In this manner, when the valve element 8 (see FIG. 1) is opened, the fuel flow 16*a* passing through a gap 10*d* between the valve-element distal end portion 13 and the valve-seat seating surface 10*a* to flow from the injection hole 12 into the concave portion 17 can be sufficiently spread along the concave-portion inner wall surface 17*b*.

As a result, the flow along the curvatures of the injection hole 12 and the concave portion 17 is reinforced as being closer to the downstream-side end surface 11*b* of the injection-hole plate 11. As a result, the liquid film can be injected after being spread further thinly.

Although the case where the fuel injection valve 1 is installed to the engine intake pipe 20 has been described in the first to eighth embodiments described above, it is apparent that the fuel injection valve 1 may also be installed to an intake port or a cylinder head.

Moreover, although the concave portion 17 has been described as being formed substantially circular, any other shape can be adopted without being limited to the circle.

Further, although a specific method of forming the concave portion 17 has not been mentioned in the first to eighth embodiments described above, the concave portion 17 may be formed by relatively simple press molding.

In this manner, the atomization and the aggregation of the sprays can be both achieved while restricting a variation in flow rate at low costs.

REFERENCE SIGNS LIST

1 fuel injection valve, 2 solenoid device, 3 housing, 4 core, 5 coil, 6 armature, 6*a* armature outer side surface, 6*b* armature upper surface, 7 valve device, 8 valve element, 9 valve main body, 10 valve seat, 10*a* valve-seat seating surface, 10*b* downstream-side end surface, 10*c* valve-seat opening inner wall, 10*d* gap, 11 injection-hole plate, 11*a*, 11*a'* welded portion, 11*b* downstream-side end surface, 11*c* upstream-side end surface, 12, 12*d*, 12*h*, 12*j* injection hole, 12*a* injection-hole inlet, 12*b* injection-hole outlet, 12*c* reference injection hole, 12*g* cylindrical portion, 13 valve-element distal end portion, 13*a* groove, 13*b* sliding surface, 14 compression spring, 15 cavity, 15*a* cavity inner wall, 16 fuel, 16*b* fuel main flow, 16*f* injection direction, 17 concave portion, 17*a* center, 17*b* concave-portion inner wall surface, 17*c* concave-portion bottom surface, 18 valve-seat axial center, 20 engine intake pipe, 21 intake valve, θ inter-injection hole angle, α fuel turn angle, β injection-hole arrangement angle, φ diameter, h height immediately above injection hole, r distance, H height in direction of valve-seat axial center, L inter-center distance, S area of concave portion, S1 bottom-surface area, S2 opening area

The invention claimed is:

1. A fuel injection valve, comprising:

a valve seat having a valve-seat seating surface provided on an open end of the fuel injection valve;

a valve element provided so as to be opposed to the valve seat, for opening and closing the valve seat; and an injection-hole plate mounted on a downstream side of the valve seat, having a plurality of injection holes, the fuel injection valve being configured to operate the valve element in a valve-opening direction in response to an operation signal from an engine control unit so as to allow a fuel to pass between the valve element and the valve-seat seating surface, to thereby inject a spray aggregate from the plurality of injection holes toward an intake valve, wherein the plurality of injection holes are formed on a radially outer side of a valve-seat opening inner wall that is a portion having a minimum inner diameter of the valve seat with a diameter reduced toward the downstream side, wherein the valve seat has a cavity formed in a downstream-side end surface of the valve seat, for bringing the valve-seat opening inner wall and each of the plurality of injection holes into communication with each other, wherein, when a straight line obtained by projecting a cylinder central axis (O) of an engine onto a plane (N) that is perpendicular to a valve-seat axial center of the valve seat is a P-axis, a straight line passing through the valve-seat axial center and being perpendicular to the P-axis on the plane (N) is an X-axis, a straight line parallel to the P-axis on the plane (N) is a Y-axis, and when one of the plurality of injection holes in a case where injection-hole inlets and injection-hole outlets of the plurality of injection holes are projected vertically onto the plane (N) is set as a reference injection hole, an inter-injection hole angle ($\theta$), which is formed by a straight line (a) passing through a center of the injection-hole inlet of the reference injection hole and the valve-seat axial center and a straight line (b) passing through a center of the injection-hole inlet of the injection hole adjacent to the reference injection hole along a radial direction and the valve-seat axial center on the plane (N), is set such that the inter-injection hole angle ($\theta$) becomes smaller the closer the corresponding injection holes are to the Y-axis, and a fuel turn angle ($\alpha$) on a wide-angle side in an angle formed by the straight line (a) and a straight line (c) passing through the center of the injection-hole inlet and a center of the injection-hole outlet on the plane (N) satisfies a relationship: $90° < \alpha < 180°$, wherein the injection-hole plate comprises concave portions formed on a downstream-side end surface of the injection-hole plate on a one-to-one basis with respect to the plurality of injection holes, each having a larger opening area than an opening area of the each of the plurality of injection holes, wherein the concave portions are arranged so that a region where an injection-hole length is short becomes larger on a side of a desired injection direction than on an opposite side with respect to the straight line (c), and wherein the injection-hole inlets are arranged in a virtual circle on the plane (N).

2. A fuel injection valve according to claim 1, wherein, when a circle formed by projecting a cavity inner wall of the cavity vertically onto the plane (N) is a virtual circle, a distance (r) from an edge of each of the injection-hole inlets on a radially outer side with respect to the valve-seat axial center to the virtual circle on the straight line (a) and a diameter ($\varphi$) of the each of the plurality of injection holes satisfy a relationship: $\varphi < r$.

3. A fuel injection valve according to claim 1, wherein a height (h) immediately above the each of the plurality of injection holes, which is represented by a distance between the center of the each of the injection-hole inlets and the cavity in a direction of the valve-seat axial center, and a diameter ($\varphi$) of the each of the plurality of injection holes satisfy a relationship: $h < \varphi$.

4. A fuel injection valve according to claim 1, wherein the cavity has a tapered shape so that a height in a direction of the valve-seat axial center is reduced toward an outer circumferential side.

5. A fuel injection valve according to claim 1, wherein a distance from the valve-seat axial center to the center of the each of the injection-hole inlets on the plane (N) is set so as to become shorter the closer the injection-hole inlet is to the X-axis.

6. A fuel injection valve according to claim 1, wherein a distance from the valve-seat axial center to the center of the each of the injection-hole inlets on the plane (N) is set so as to become shorter the closer the injection-hole inlet is to the Y-axis.

7. A fuel injection valve according to claim 1, wherein, when a plane that is perpendicular to a central axis of the each of the plurality of injection holes is a cross section in a flow path of the each of the plurality of injection holes, a cylindrical portion having a minimum area in a radial direction of the each of the plurality of injection holes as a cross section is ensured between an upstream-side end surface of the injection-hole plate and a bottom surface of each of the concave portions.

8. A fuel injection valve according to claim 1, wherein the each of the concave portions is configured so that an opening area open on the downstream-side end surface of the injection-hole plate becomes larger than a bottom-surface area the each of the concave portions.

9. A fuel injection valve according to claim 1, wherein the concave portions are formed by press molding.

* * * * *